US010301153B2

(12) United States Patent
Johnston

(10) Patent No.: US 10,301,153 B2
(45) Date of Patent: May 28, 2019

(54) PIVOTING AXLE WHEELED MOBILE GANTRY

(71) Applicant: J & R Engineering Company, Inc., Mukwonago, WI (US)

(72) Inventor: Roger L. Johnston, Mukowonago, WI (US)

(73) Assignee: J & R Engineering Company, Inc., Mukwonago, WI (US)

( * ) Notice: Subject to any disclaimer, the term of this patent is extended or adjusted under 35 U.S.C. 154(b) by 566 days.

(21) Appl. No.: 14/858,359

(22) Filed: Sep. 18, 2015

(65) Prior Publication Data

US 2017/0081155 A1 Mar. 23, 2017

(51) Int. Cl.
*B66C 19/00* (2006.01)
*B66C 9/12* (2006.01)

(52) U.S. Cl.
CPC ..... *B66C 19/007* (2013.01); *B66C 9/12* (2013.01)

(58) Field of Classification Search
CPC ..... B66C 9/12; B66C 19/007
See application file for complete search history.

(56) References Cited

U.S. PATENT DOCUMENTS 5,638,420 A * 6/1997 Armistead ..... B66C 19/007 378/146
5,715,958 A * 2/1998 Feider ..... B66C 1/101 212/273
5,839,874 A 11/1998 Johnston
6,017,181 A 1/2000 Johnston
7,344,037 B1 * 3/2008 Zakula, Sr. ..... B66C 13/46 212/270
8,793,822 B2 * 8/2014 Martin ..... A61G 7/1019 5/81.1 R
9,708,163 B2 * 7/2017 Ojapalo ..... B66C 9/00
9,771,245 B2 * 9/2017 Kang ..... B66C 13/12
2003/0161708 A1 8/2003 Johnston
2013/0045070 A1 2/2013 Waisanen et al.
2013/0121796 A1 5/2013 Terry
2014/0017051 A1 1/2014 Coogan et al.

FOREIGN PATENT DOCUMENTS

EP 92152 A2 10/1983

* cited by examiner

*Primary Examiner* — Saul Rodriguez
*Assistant Examiner* — Ashley K Romano
(74) *Attorney, Agent, or Firm* — Boyle Fredrickson, S.C.

(57) ABSTRACT

A mobile gantry for transporting heavy loads includes first, second, and third booms which are supported on the ground by respective wheel sets. The booms are spaced from one another so to present a generally triangular configuration when viewed from above. First, second, and third lift legs telescope to extend and retract the booms, and the lift legs are interconnected to one another and can raise and lower a load. The load can be maintained level by individually adjusting the length of each boom by extending and retracting the lift legs. A pivot axle, attached to each one of the wheel sets, allows each of the wheel sets to pivot about an axis that is at least generally parallel to the ground, thus maintaining a uniform load while the mobile gantry encounters changes in slope or other surface irregularities.

19 Claims, 6 Drawing Sheets

PIVOTING AXLE WHEELED MOBILE GANTRY

BACKGROUND OF THE INVENTION

1. Field of the Invention

The present invention relates generally to material handling and transport of massive loads such as spent nuclear fuel rod storage casks. More particularly, the invention relates to a self-propelled wheeled gantry crane capable of transporting such a load and having pivoting axles for accommodating surface irregularities including changes in slope.

2. Discussion of Related Art

When nuclear power plant fuel rods are "spent" or no longer usable to generate power, they must be removed from the reactor core and replaced with fresh fuel rods. The spent fuel rods are still highly radioactive and continue to generate significant heat and emit radiation for decades. Fuel rod bundles, which consist of dozens to hundreds of fuel rods each, are moved to pools of water to cool. They typically are kept on racks in the pool, where they are submerged in more than twenty feet of water, and water is continuously circulated to draw heat away from the rods and keep them at a safe temperature.

After a sufficient period of time, typically, one to ten years, the spent fuel rods typically are transferred from the cooling pools to dry storage. Currently, there is no long-term permanent storage facility. Rods instead are stored in casks, which can be transported within a site and from site to site. Typically, 20 to 40 fuel rod bundles or assemblies are stored in a cask. Each fuel rod assembly may comprise 200 or more fuel rods. The rods typically are stored in a vertical orientation with the cask. Casks also are typically steel cylinders that are either welded or bolted closed. The casks may also include a concrete shell for added protection from radiation. The spent fuel rods inside may also be surrounded by inert gas. Ideally, the casks provide a leak-tight containment for the spent fuel rods.

Nuclear fuel rod storage casks typically are cylindrical. They are also very massive, ranging in diameter from five to ten feet, in height from ten to twenty feet, and may weigh more than 100 tons when filled. Such massive casks cannot be transported with traditional material handling devices such as forklifts. Cask transport is further complicated by the uncompressing need to transport casks safely with minimal shocks to the casks and their contents.

Spent nuclear fuel rod storage casks traditionally are transported with "crawler" type transporters that are supported on the ground by a pair of spaced tracks. More recently, wheeled-type transporters have been proposed. In both cases, the transporter is supported at multiple locations on each side of the machine to distribute the load. These locations comprise rollers in the case of crawler-type transporters and wheels in the case of wheeled transporters. A problem with both types of transporters is that they are incapable of uniformly distributing the load in the desired manner over the machine's rolling gear as the machine encounters surface irregularities. For example, a single roller or wheel at time may carry the load if the machine encounters a significant bump. Similarly, a the entire load me be borne by less than all rollers or wheels or even a single roller or wheel on each side of the machine as the machine encounters a hump, incline, or other change in slope.

As casks are known to weigh upwards of 100 tons, placing the entire load on a small percentage of the intended support area causes significant wear and reduces life expectancy. Traversing a valley, hump, or other grade change also can force the transporter to experience a hard shock load when traversing the grade change. What is therefore needed is a cask transporter that can traverse over surface irregularities while evenly distributing the load, over at least substantially the entire surface area of the transport's rolling gear. What also is needed is a cask transporter that can encounter changes in slope without experiencing shock loading. An additional need is for a transporter with an articulating suspension for traversing over uneven ground.

The need additionally exists to provide a method of improving the ability of a cask transporter to traverse service irregularities.

SUMMARY OF THE INVENTION

In accordance with a first aspect of the invention, the above-identified needs are met by providing a mobile gantry crane configured to lift a spent nuclear fuel rod storage cask or other load of comparable size and mass. The mobile gantry includes first, second, and third booms arranged in a triangular configuration and supported on the ground by first, second, and third wheel sets. The first and second booms may be longitudinally offset from the third boom, while the third boom is located laterally between the first and second booms.

The booms may be interconnected by a first beam joining the first and second booms, a second beam joining the second and third booms, and a third beam joining the first and third booms, forming a generally triangular configuration, when viewed from overhead.

Each one of the wheel sets is equipped with a pivot axle configured to allow the wheel sets to pivot about an axis extending generally parallel to the ground and extending transversely of the mobile gantry. The pivot axles allow the wheel sets to maintain a generally uniform load while the mobile gantry encounters a change in slope or traverses otherwise uneven ground. The pivot axle for each one of the wheel sets may be located either above or below a rotational axis of the wheels.

In order to pick up a load, such as a spent nuclear fuel rod storage cask, each one of the booms is equipped with a lift leg. The first boom therefore includes a first lift leg, a second lift leg is attached to the second boom, and a third lift leg is attached to the third boom. Each one of the lift legs may be configured to telescope from a respective end of the first, second, and third booms when in an extended position, and to retract within the respective first, second, and third boom, when in a retracted position. This allows the beams to be attached with rigging to the cask and to extend to pick the cask off the ground. The rigging may be suspended from a load, beam joining at least two of the beams together.

The first, second, and third lift legs can be controlled to extend and retract independently such that the first, second, and third beams can be maintained horizontally level while traversing over a slope of for example, up to five degrees.

Also provided is a method of operating a wheeled mobile gantry of the at least generally the type described above.

These and other aspects, advantages, and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof. It is hereby disclosed that the invention include all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

Figure 1:
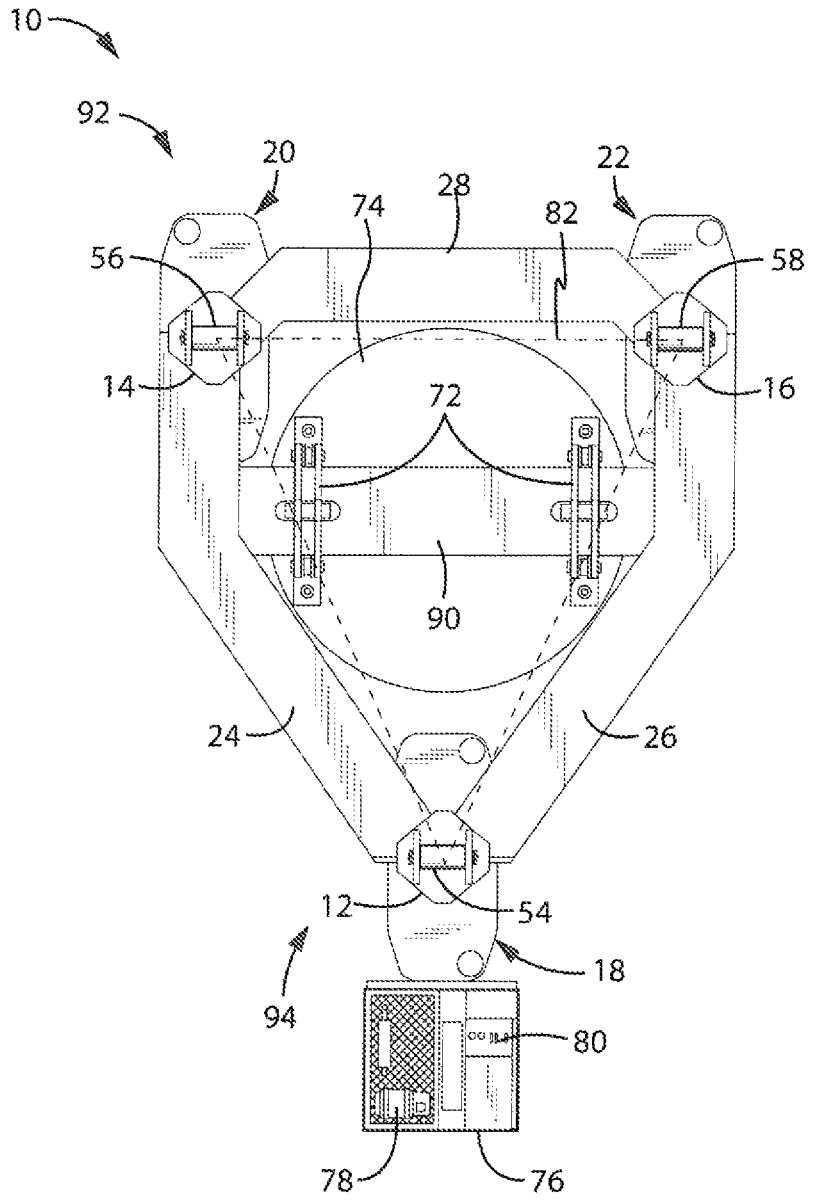
FIG. 1 is a top plan view of a mobile, wheeled gantry constructed in accordance with an embodiment of the present invention and having pivot axles above the rotational center of the wheels.

FIG. 1 shows an overhead view of a mobile gantry 10 constructed in accordance with an embodiment of the invention. The mobile gantry 10 of this embodiment has a delta or generally triangular configuration when viewed from above. Gantry 10 has a first boom 12, a second boom 14, and a third boom 16 arranged in a triangular configuration 82 as detailed below.

Figure 2:
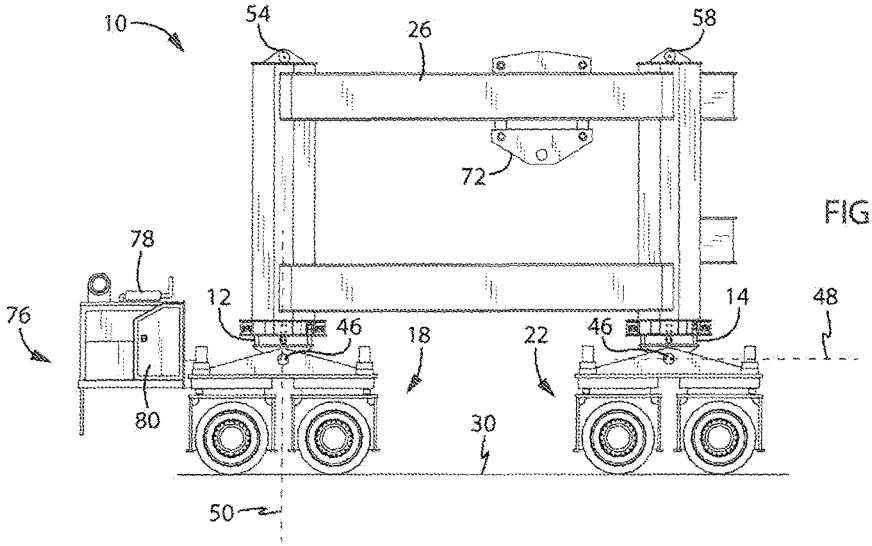
FIG. 2 is a side elevation view of the gantry of FIG. 1, operating on a horizontal or "level" surface.
Figure 3:
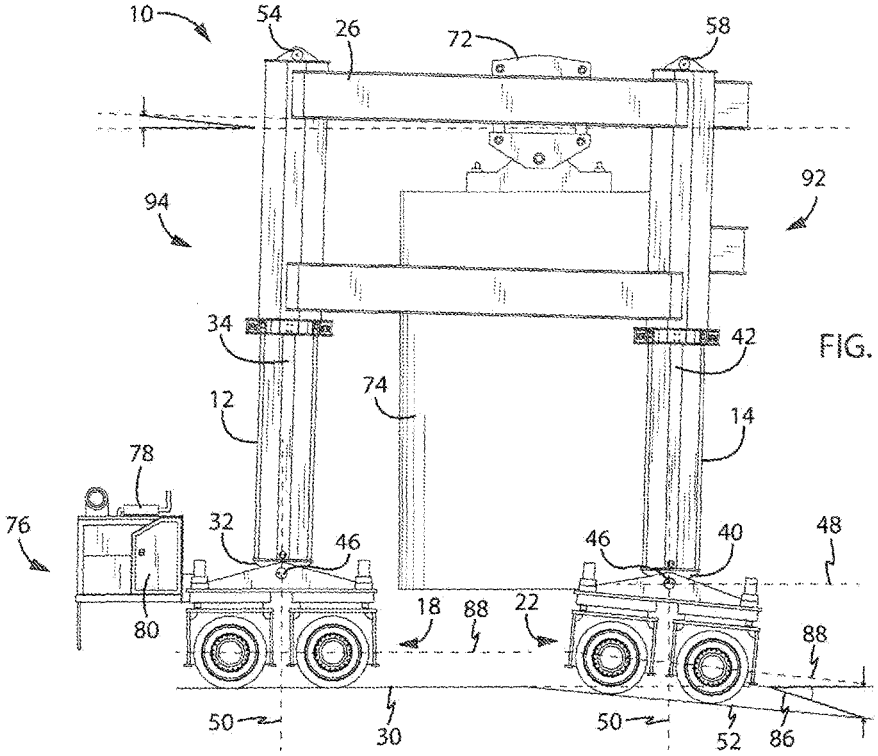
FIG. 3 is a side elevation view of the gantry of FIG. 1 with the two front wheel sets on a sloping ground and a single rear wheel set on level ground.

Referring now to FIGS. 1-3, each one of the first boom 12, second boom 14, and third boom 16 can independently telescope to extend and retract. The mobile gantry 10 utilizes a hydraulic system with hydraulic cylinders attached to each one of the booms that extend and retract lift legs associated with the booms. The first boom 12 receives a first lift leg 54 that is extended and retracted using one or more hydraulic cylinders. Similarly, the second boom 14 receives a second lift leg 56 that is extended by at least one hydraulic cylinder. The third boom 16 receives a third lift leg 58 that is extended by at least one hydraulic cylinder. The first boom 12 is located at the rear of the gantry 10 at or near the longitudinal centerline of the gantry 10. The second and third booms 14 and 16 are located at the front of the gantry 10 at the left and right sides of the gantry 10, respectively. The booms 12, 14, and 16 thus form an isosceles triangle when viewed in plan. The resultant effective three-point support provides enhanced stability when compared to more traditional two point or four point supports found on other transporters.

The first lift leg 54, second lift leg 56, and third lift leg 58 are all joined together by a first beam 24, a second beam 26, and a third beam 28. Each one of the beams is attached to the tops of two lift legs to form a generally triangular configuration. The first and second beams 24 and 26 each have a rear end attached to the lift leg 54 and a front end attached to a respective one of the lift legs 56 and 58. Each of these beams 24 and 26 includes a rear section that is inclined outwardly and forwardly from the lift leg 54 to the outer edge of the machine, and a front section that extends longitudinally from the rear section to the associated lift leg 56 or 58. A load beam 90 spans the beams 24 and 26 at the rear end of the front end section thereof, for attachment to a load 74. The load 74 may, for example, be a spent nuclear rod storage cask weighing in excess of 100 tons.

Typically, 20 to 40 fuel rod bundles weighing over ten tons are stored in a cask. The casks can each weigh over one hundred tons and be as large as ten feet wide and twenty feet tall. As a result, the load 74 is massive and requires a large, substantial mobile gantry for material handling.

The mobile gantry 10 is configured to transport such a load 74 in the form of a nuclear fuel rod cask or a structure of a similar size and mass. The load may be transported by driving the mobile gantry 10 such that the third beam passes over the load 74, and the mobile gantry is stopped with the load beam 90 directly over the load 74. The load rigging 72 may be attached to the load 74. After the load 74 is attached to the load rigging 72, the first lift leg 54, second lift leg 56, and third lift leg 58 may be extended in unison to raise the load 74 off the ground. Once the load 74 is off the ground, the mobile gantry 10 may be driven to transport the load.

The mobile gantry 10 is controlled from an operator platform 76 at a rear side 94 of the mobile gantry 10. Located on platform 76 are controls 80 and a power source 78. Preferably, the power source 78 is a diesel engine, but any other power source may be used. The operator controls 80 may be manually operated and take the form of, for example, any or all of touch screen controls, analog joysticks/levers, or even remotely controlled. Other controls are provided for operating the lift legs and other components of the mobile gantry 10.

The mobile gantry 10 may be moved by rolling on wheel sets. A first wheel set 18 supports the first boom 12, a second wheel set 20 supports the second boom 14, and a third wheel set 22 supports the third boom 16. One or more of the wheel sets may independently pivot about a vertical axis to allow the mobile gantry 10 to be steered in any direction. For example, only the center wheel set 18 could pivot, such as is typically the case with a tricycle. Alternatively, each of three wheel sets 18, 20, and 22 could pivot about a respective vertical axis. Each of the wheel sets also is configured to independently pivot about a horizontal axis (assuming the gantry is on a horizontal surface) allowing the mobile gantry 10 to accommodate changes in inclination without overloading a single wheel set. The pivoting action of the wheel sets is not only made possible by the pivot axle 46, but also because there is at least one wheel in front of and behind the pivot axle 46. By having wheels both in front and behind the pivot axle 46 on each wheel set, a uniform load can be distributed on both ends of the wheel set. Each wheel rotates about an axle. Two or more wheels be mounted on each axle, as can appreciated by FIG. 8, which shows two wheels on each axle. Alternately, all wheels of at least the rear wheel set 18 could be mounted on a common axis with the rear pivot axle. The same could theoretically be said of each of the front wheel sets 20 and 22, but only at the expense of undesirably adding width to the machine due to the need to have so many wheels located on a common axis. Although only two (front and rear) axles are shown, more axles could be provided at the front and rear of any or all of the wheel sets, thereby improving the load distribution capacity of each wheel set. It is conceivable that each wheel set could have 4 or more, 6, or more, or even 10 or more wheels.

Referring now to FIG. 2, the first wheel set 18 and the third wheel set 22 may be seen from the side. The second wheel set 20 is obscured from view behind the third wheel set 22. Each one of the wheel sets includes a pivot axle 46 that allows the wheel set to pivot about a generally horizontal axis 48 at a vertical centerline 50 of each boom.

The pivot axles 46 ensure that the wheel sets maintain a generally uniform load on all wheels as the mobile gantry 10 encounters a change in slope, such as when it transitions from a level ground 30 to a sloping ground 52, as seen in FIG. 3. When the mobile gantry is transitioning to sloping ground 52, the wheel set centerline 88 pivots about the pivot axle 46 to become parallel to the slope of the sloping ground 52. The pivot axle 46 of the first wheel set 18 thus maintains the wheel centerline 88 of the first wheel set 18 parallel to the level ground 30. The second wheel set 20 is also on sloping ground 52, as it is obscured from sight behind the third wheel set 22. An at least generally uniform load thus is maintained on all wheels as the pivot axles 46 allow the second and third wheel sets 20 and 22 to pivot so that all of the wheels of each set remain in full contact with the sloping ground 52. If the wheel sets were not allowed to pivot about a horizontal axis, the front portions of the second and third wheel sets 20 and 22 would not contact the sloping ground 52 until the center of gravity of the mobile gantry 10 moved beyond the point of slope transition. At that point, the entire mobile gantry 10 would tilt and impose a shock load the second wheel set 20 and third wheel set 22. The total distance that the wheel sets would be above the ground in such a situation may appear minimal. However, due to the immense loads of over one hundred tons, the added load on any wheel that remains in contact causes premature wear and a potential for failure. The pivot axels 46 and wheel sets 18, 20, and 22 preferably are dimensioned and configured to accommodate a change in slope of at least 5°.

In order to maintain the load 74 in a level position despite the fact that the gantry crane 10 is transitioning to or travelling along a slope, each one of the lift legs may be operated independently of the other lift legs to maintain the beams 24, 26, 28, and 90 in a common horizontal plane. The independent adjustment of the lift legs may accommodate an additional 5° of slope, thus permitting a total change in slope in the fore and aft direction of up to 10°.

The operator may control the mobile gantry 10 from the operator's platform to maintain the load 74 horizontally level. Maintaining the load level also will help balance the distribution of weight of the load 74 evenly on all booms.

Figure 4:
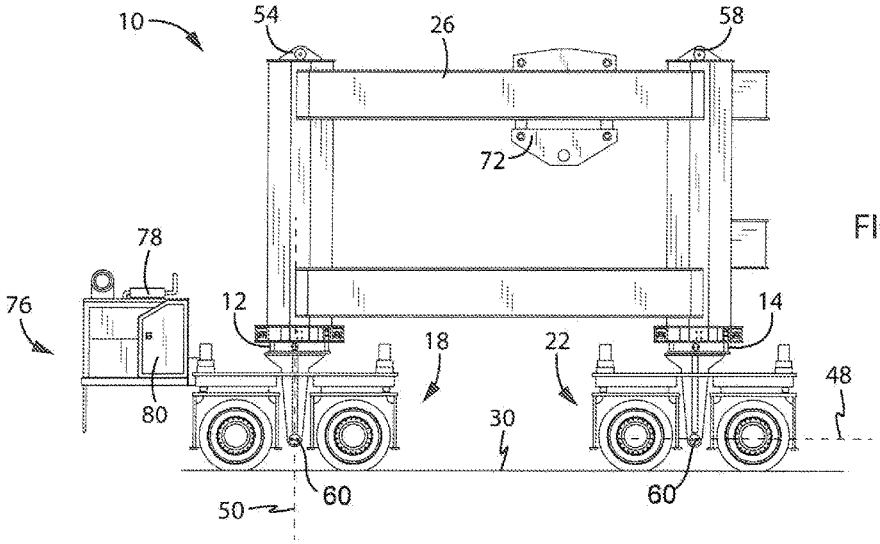
FIG. 4 is a side elevation view of an alternative embodiment of a gantry with pivot axles below the rotational center of the wheels on level ground.
Figure 5:
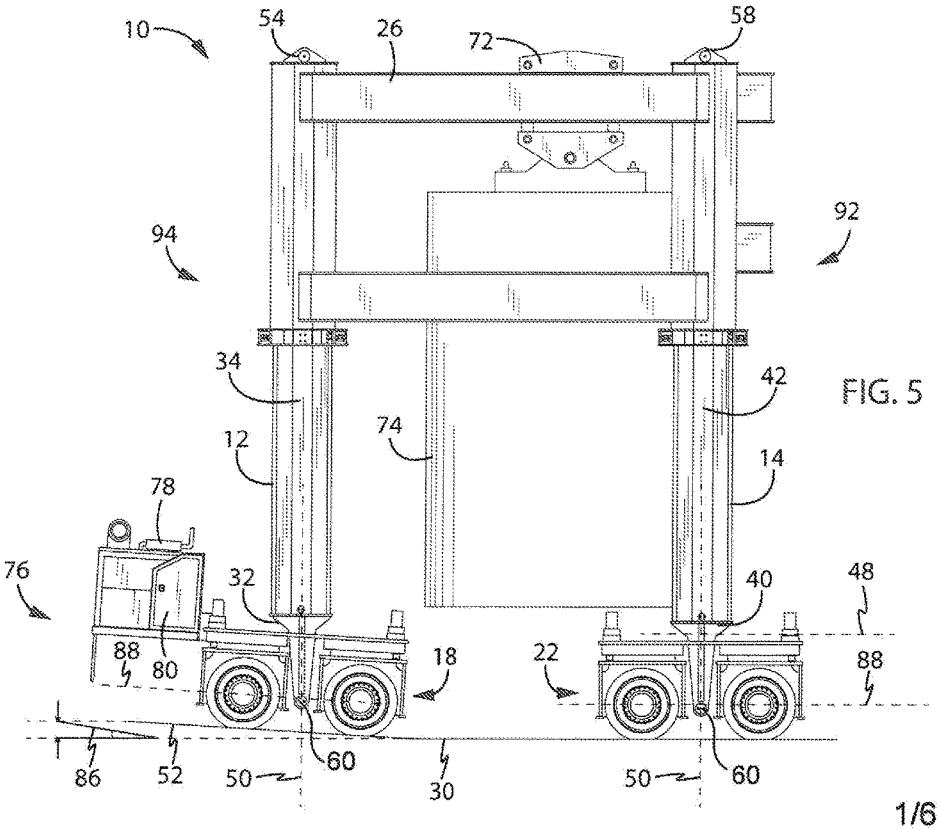
FIG. 5 is a side elevation view of the gantry of FIG. 4 the single, rear side wheel set on a sloping ground and the two front wheel sets on level ground.

Referring now to FIGS. 4 and 5, an alternative embodiment of the invention is shown. The pivot axles 60 are located below the wheel centerline 88 while all other aspects of the mobile gantry 10 remain unchanged. It can thus be seen that the pivot axles 60 may be located either above, below, or even at the wheel centerline 88.

FIG. 5 also shows the first wheel set 18 on sloped ground 52 while the front side 92 of the mobile gantry 10 including the second wheel set 20 and third wheel set 22 remain on level ground 30. The angle 86 of incline of the sloped ground 52 matches the wheel centerline 88 angle of intersection with the level ground 30. This is due to the fact that the pivot axle 60 freely adjusts for the angle 86 and maintains all weight evenly distributed on all the wheels in contact with the ground.

Figure 6:
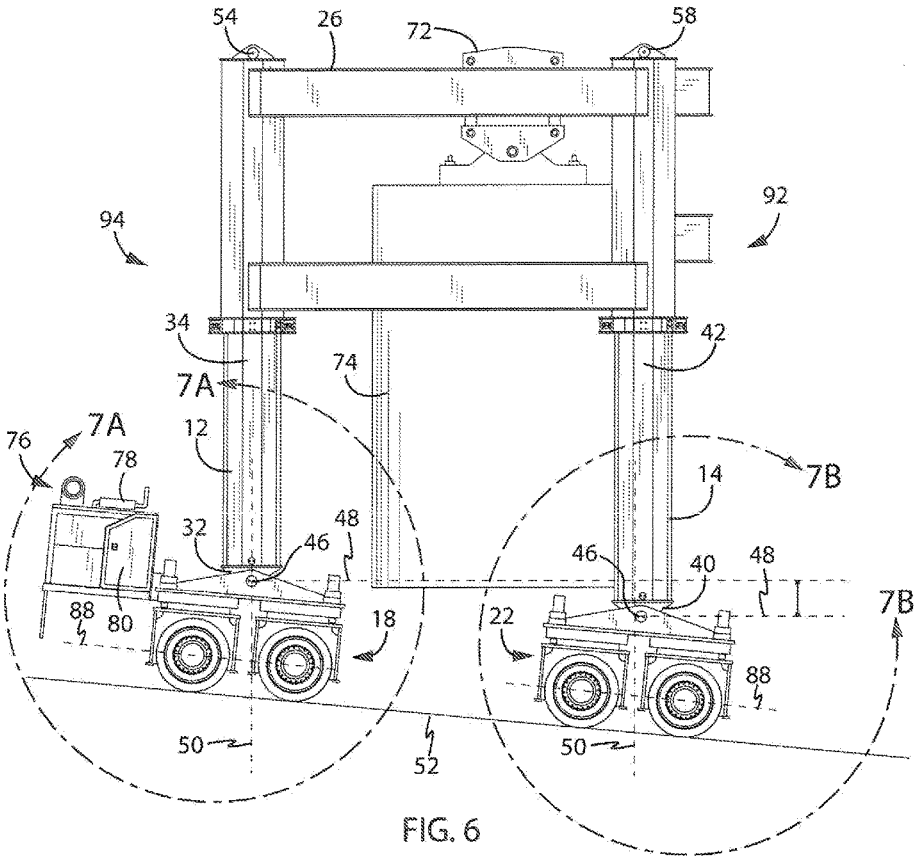
FIG. 6 is a side elevation view of the gantry of FIG. 1 with all wheel sets on sloping ground.

Referring now to FIG. 6, the load 74 is maintained vertically and horizontally level despite all three wheel sets being on sloped ground 52. In order to maintain the load 74 level, the lift legs on the front side 92 are extended longer than the lift leg on the rear side 94 of the mobile gantry 10. The height difference 100 of the front side 92 wheel sets is dependent upon the magnitude of the slope. Adjusting the lift legs maintains the load 74 level while on the sloped ground 52. The pivoting action of the wheel sets due to the operation of the pivot axles 46 maintains a consistent load on the wheel sets while transitioning to the slope and prevents overloading on a single wheel set. The pivot axles also ensure that each one of the booms remains vertically level.

As the mobile gantry 10 transitions from the peak of a slope, the pivot axles 46 of the wheel sets on the front side 92 can pivot about the one horizontal pivot point, while the pivot axle 46 on the rear side 94 can also pivot to allow differential movement. This allows the mobile gantry 10 to traverse over the peak of a slope all while maintaining the entire contact path of the wheel sets on the ground at all times, thus maintaining a uniform load on each one of the wheel sets.

Figure 7B:
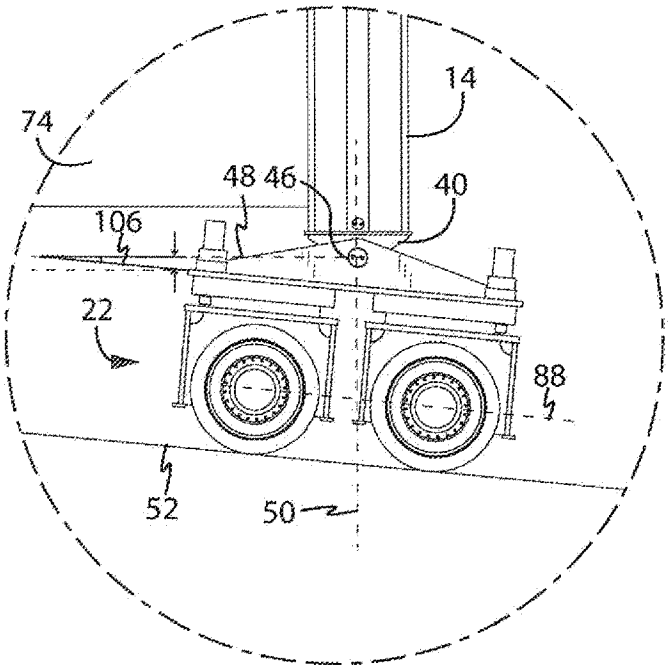
FIG. 7B is a detail view of a front side wheel set in magnification area 7B:7B as shown in FIG. 6.
Figure 7A:
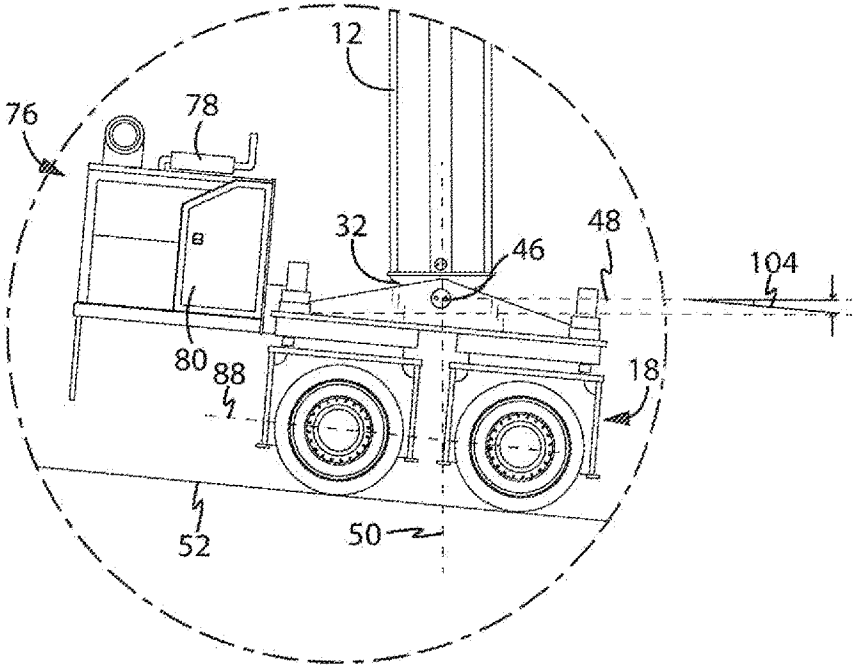
FIG. 7A is a detail view of a rear side wheel set in magnification area 7A:7A as shown in FIG. 6.

FIGS. 7A and 7B show a close-up of the first wheel set 18 and third wheel set 22 on the sloped ground 52, as shown in FIG. 6. The first wheel set in FIG. 7A is shown pivoted about the pivot axle 46 at an angle 104 that matches the angle of the sloped ground 52. Similarly, the third wheel set 22 shown in FIG. 7B is rotated at an equal angle 106 as both wheel sets are on the same sloped ground 52. The pivoting wheel sets and the individual adjustment of each one of the lift legs and booms can be adjusted to maintain the booms vertically level, which maintains the load 74 level.

Figure 8:
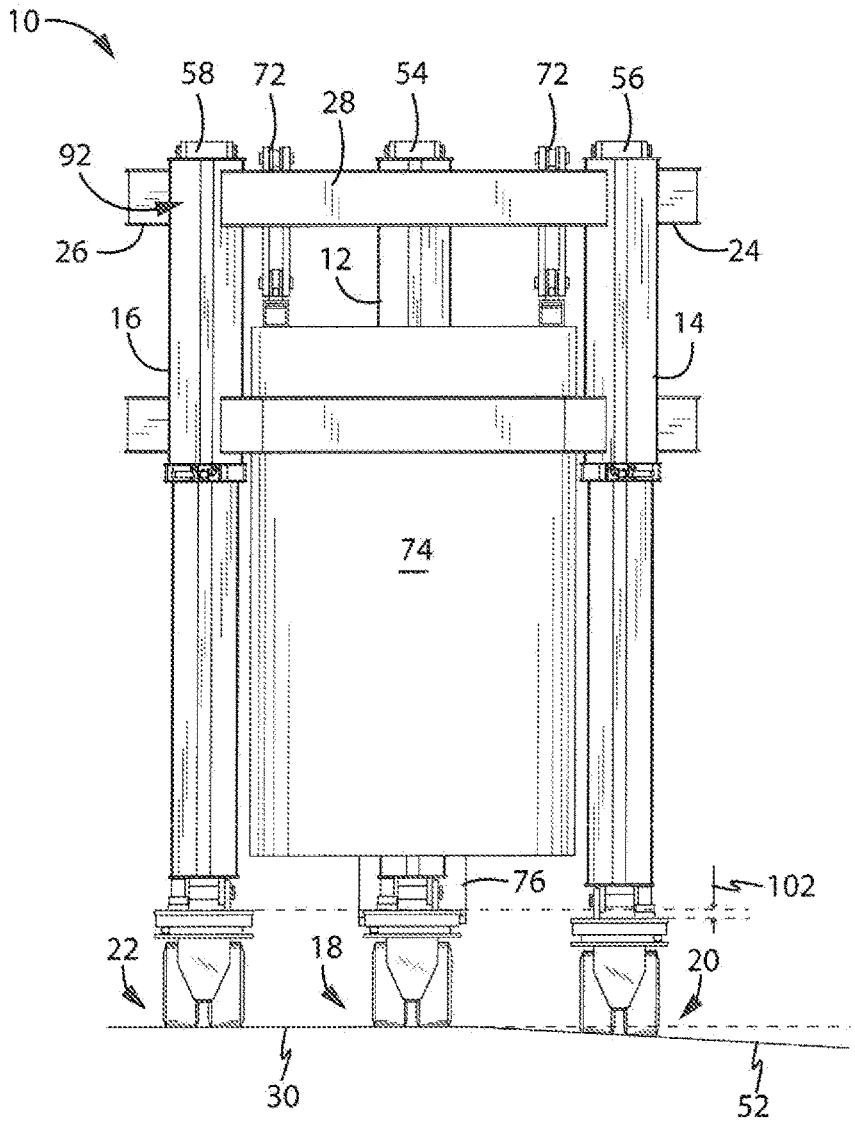
FIG. 8 is a front elevation view of the gantry of FIG. 1 with a single, front side wheel set on sloping ground.

FIG. 8 shows the front side 92 of the mobile gantry 10 traversing over a side slope with a single wheel set on the sloped ground 52. In this example, the mobile gantry is maintaining the second wheel set 20 on the sloped ground as it traverses. In order to accommodate for the height difference 102 between the wheel set 20 and the wheel sets 18 and 22, the second lift leg 56 is extended the amount of the height difference 102, and all three of the booms and lift legs are vertically level and parallel with one another. This also maintains the load 74 level. A side-to-side slope, as shown in FIG. 8, may only be accounted for by individually adjusting the lift legs. The pivot axles 46 are only capable of pivoting toward the front side 92 and the rear side 94 of the mobile gantry 10.

Controlling the extension and retraction of the lift legs could be performed manually by an operator using the operator controls. Alternative embodiments may use automation to allow the mobile gantry 10 to self-adjust. For example, an inclinometer may be used to detect an out-of-level condition for the load 74 and/or for each of the booms. The resulting signals may then be used as feedback to control the lift legs and level out booms and beams.

Although the best mode contemplated by the inventors of carrying out the present invention is disclosed above, practice of the present invention is not limited thereto. It will be manifest that various additions, modifications, and rearrangements of the aspects and features of the present invention may be made in addition to those described above without deviating from the spirit and scope of the underlying inventive concept.

It is appreciated that many changes and modifications could be made to the invention without departing from the spirit thereof. Some of these changes will become apparent from the appended claims. It is intended that all such changes and/or modifications be incorporated in the appending claims.

I claim:

1. A mobile gantry comprising:

a first boom having a first, lower end and a second, upper end opposite the first end;

a first wheel set supporting the first end of the first boom on the ground;

a second boom having a first end and a second end opposite the first end;

a second wheel set supporting the second boom on the ground;

a third boom having a first end and a second end opposite the first end;

a third wheel set supporting the third boom on the ground, wherein the mobile gantry extends longitudinally from front to rear ends thereof and laterally from first to second sides thereof, wherein the first, second and third booms are offset from one another so as to present a triangular configuration when viewed from above with the third boom being spaced longitudinally from and positioned laterally between the first and second booms;

first, second, and third pivot axles, each of which is attached to a respective one of the wheel sets and configured to allow the wheel set to pivot longitudinally about a pivot axis toward a front side of the mobile gantry and toward a rear side of the mobile gantry;

wherein the pivot axis extends laterally of the mobile gantry and at least generally parallel to the ground; and wherein each of the first, second, and third wheel sets includes wheels that rotate about axles that are parallel with but offset from the respective pivot axis.

2. The mobile gantry according to claim 1, further comprising:

a first lift leg attached to the first boom;

a second lift leg attached to the second boom;

a third lift leg attached to the third boom; and beams interconnecting the first, second, and third lift legs;

wherein the first, second, and third lift legs are configured to telescope from a respective end of the first, second, and third booms when in an extended position, and to retract within the respective first, second, and third boom when in a retracted position.

3. The mobile gantry according to claim 2, further comprising a hydraulic cylinder connected to each one of the first, second, and third lift legs and configured to individually and independently extend and retract each one of the lift legs.

4. The mobile gantry according to claim 3, further comprising:

a load rigging configured to suspend a load from the first, second, and third beams, and wherein the pivot axles and hydraulic cylinders are configured to independently move such that the load can be maintained horizontally level as the mobile gantry traverses surface irregularities.

5. The mobile gantry according to claim 3, further comprising:

a load rigging configured to suspend a load from the first, second, and third beams; and wherein the pivot axles and hydraulic cylinders are configured to work together to accommodate a change in both pitch and yaw in the non-planar ground such that the load is maintained horizontally level.

6. The mobile gantry according to claim 2, wherein said first, second, and third lift legs are controllable to extend and retract independently of one another such that the first, second, and third beams may be maintained horizontally level while the mobile gantry traverses over a sloping ground.

7. The mobile gantry according to claim 2, wherein the beams interconnecting the first, second, and third lift legs include a first beam extending from the first lift leg to the second lift leg, a second beam extending from the first lift leg to the third lift leg, and a third beam extending from the second lift leg to the third lift leg to form a generally triangular configuration.

8. The mobile gantry according to claim 7, further comprising a load beam spanning the first and second booms between the first lift leg and the third beam.

9. The mobile gantry according to claim 1, wherein the pivot axles are configured to maintain the first, second, and third booms in a vertical orientation while the mobile gantry traverses over a sloping ground.

10. The mobile gantry according to claim 1, wherein the pivot axle for each one of the wheel sets is located one of above and below a rotational axis of the wheels of the respective wheel set.

11. The mobile gantry according to claim 1, wherein at least one wheel of each wheel set rotates about an axis located in front of its respective pivot axle and at least one wheel of each wheel rotates about an axis that is behind its respective pivot axle.

12. The mobile gantry according to claim 1, wherein each pivot axle allows its respective wheel set to pivot independently of the other wheel sets.

13. A mobile gantry comprising:

a first boom having a first end and a second end opposite the first end;

a first wheel set attached to the first end of the first boom;

a second boom having a first end and a second end opposite the first end;

a second wheel set attached to the first end of the second boom;

a third boom having a first end and a second end opposite the first end, wherein the mobile gantry extends longitudinally from front to rear ends thereof and laterally from first to second sides thereof, wherein the first and second booms are longitudinally offset from the third boom and the third boom is located laterally between the first and second booms so as to present a generally isosceles triangular configuration when viewed from above;

a third wheel set attached to the first end of the third boom;

a first beam joining each one of the first and second booms;

a second beam joining the second and third booms;

a first lift leg attached to the first boom;

a second lift leg attached to the second boom;

a third lift leg attached to the third boom;

wherein the first, second, and third lift legs are configured to telescope from a respective end of the first, second, and third booms when in an extended position and to retract within the respective first, second, and third booms when in a retracted position, and wherein the first, second, and third lift legs are controllable to extend and retract independently of one another such that the first, second, and third beams may be configured to be maintained horizontally level while the mobile gantry traverses over a sloping ground;

first, second, and third pivot axles, each of which is attached to a respective one of the wheel sets and which configured to allow the wheel set to pivot about a pivot axis that extends laterally of the mobile gantry and that extends at least generally parallel to the ground, and wherein each of the first, second, and third wheel sets includes wheels that rotate about axles that are parallel with but offset from the respective pivot axis;

a load beam joining the first and second beams; and a load rigging suspended from the load beam and configured to suspend a load when the lift legs are in an extended position.

14. The mobile gantry according to claim 13, wherein the pivot axle for each one of the wheel sets is located one of above and below a rotational axis of the wheels.

15. The mobile gantry according to claim 14, further comprising an operator platform with a power source and operator controls configured to control the mobile gantry.

16. The mobile gantry according to claim 13, wherein the load beam spans the first and second beams between the first lift leg and the third beam.

17. The mobile gantry according to claim 13, wherein each pivot axle allows its respective wheel set to pivot independently of the other wheel sets.

18. A. mobile gantry comprising:

a first boom having a first, lower end and a second, upper end opposite the first end;

a first wheel set supporting the first end of the first boom on the ground;

a second boom having a first end and a second end opposite the first end;

a second wheel set supporting the second boom on the ground;

a third boom having a first end and a second end opposite the first end;

a third wheel set supporting the third boom on the ground, wherein the mobile gantry extends longitudinally from font to rear ends thereof and laterally from first to second sides thereof, wherein the first, second and third booms are offset from one another so as to present a triangular configuration when viewed from above with the third boom being spaced longitudinally from and positioned laterally between the first and second booms;

first, second, and third pivot axles, each of which is attached to a respective one of the wheel sets and to a respective one of the booms, wherein each of the pivot axles extends laterally of the mobile gantry and is configured to allow the respective wheel set to pivot about the pivot axle, wherein each of the pivot axles extends horizontally when the mobile gantry is supported on a horizontal surface; and wherein each of the first, second, and third wheel sets has wheels that rotate about axes that are parallel to but offset from the respective pivot axle, and wherein each of the first, second, and third wheel sets includes at least one wheel disposed in front of the respective pivot axle and at least one wheel disposed behind the respective pivot axle.

19. The mobile gantry according to claim 18, wherein each pivot axle allows its respective wheel set to pivot independently of the other wheel sets.

* * * * *